US011719132B2

(12) United States Patent
Mizumi et al.

(10) Patent No.: US 11,719,132 B2
(45) Date of Patent: Aug. 8, 2023

(54) TURBINE STATOR BLADE AND STEAM TURBINE

(71) Applicant: Mitsubishi Power, Ltd., Yokohama (JP)

(72) Inventors: Shunsuke Mizumi, Tokyo (JP); Chongfei Duan, Tokyo (JP); Yasuhiro Sasao, Yokohama (JP); Soichiro Tabata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 157 days.

(21) Appl. No.: 17/433,331

(22) PCT Filed: Feb. 14, 2020

(86) PCT No.: PCT/JP2020/005867
§ 371 (c)(1),
(2) Date: Aug. 24, 2021

(87) PCT Pub. No.: WO2020/175192
PCT Pub. Date: Sep. 3, 2020

(65) Prior Publication Data

US 2022/0154586 A1 May 19, 2022

(30) Foreign Application Priority Data

Feb. 27, 2019 (JP) ..... JP2019-033564

(51) Int. Cl.
*F01D 25/32* (2006.01)
*F01D 9/04* (2006.01)
*F01D 5/14* (2006.01)

(52) U.S. Cl.
CPC ..... *F01D 25/32* (2013.01); *F01D 5/141* (2013.01); *F01D 9/041* (2013.01);
(Continued)

(58) Field of Classification Search
CPC ..... F01D 9/041; F01D 5/141; F01D 5/147; F01D 25/32; F05D 2240/122
See application file for complete search history.

(56) References Cited

U.S. PATENT DOCUMENTS 1,829,674 A * 10/1931 Rosenlocher ..... F01D 25/32 96/217
4,938,785 A 7/1990 MacPherson, Jr. et al.
(Continued)

FOREIGN PATENT DOCUMENTS

EP 2692990 A2 * 2/2014 ..... F01D 25/32
JP 2-267301 11/1990
(Continued)

OTHER PUBLICATIONS

International Search Report dated Apr. 14, 2020 in corresponding International Application No. PCT/JP2020/005867, with English translation.
(Continued)

*Primary Examiner* — Brian Christopher Delrue
(74) *Attorney, Agent, or Firm* — Wenderoth, Lind & Ponack, L.L.P.

(57) ABSTRACT

A turbine stator blade (21) includes a pressure side (21P) extending in a radial direction intersecting a flow direction of steam, and facing upstream in the flow direction. A slit (5) extending in the radial direction and capturing a liquefied component of the steam is formed on a downstream side of the pressure side (21P). A hydrophilic uneven region (6) having a liquid film capacity greater than that of the pressure side (21P) by being recessed in a depth direction intersecting the pressure side (21P) is formed in a further upstream position than the slit (5). The hydrophilic uneven region (6)
(Continued)

has a depth in the depth direction increasing and a flow resistance decreasing toward downstream and toward the slit (5).

6 Claims, 5 Drawing Sheets

(52) U.S. Cl.
CPC ..... *F05D 2220/31* (2013.01); *F05D 2240/12* (2013.01); *F05D 2260/602* (2013.01); *F05D 2300/51* (2013.01)

(56) References Cited

U.S. PATENT DOCUMENTS

| | | | | |
|---|---|---|---|---|
| 8,132,414 | B2 * | 3/2012 | Niizeki | F01D 5/288 416/241 A |
| 9,598,964 | B2 * | 3/2017 | Ishibashi | F01D 5/145 |
| 10,132,178 | B2 * | 11/2018 | Ishibashi | F01D 25/32 |
| 10,781,722 | B2 * | 9/2020 | Fandrei, II | B23K 26/0624 |
| 10,794,196 | B2 * | 10/2020 | Nakano | F01D 25/32 |
| 11,174,746 | B2 * | 11/2021 | Taniguchi | F01D 25/32 |
| 2007/0014670 | A1 * | 1/2007 | Maeno | B23P 15/04 416/232 |
| 2007/0101719 | A1 * | 5/2007 | Niizeki | F01D 5/288 60/645 |
| 2011/0150641 | A1 | 6/2011 | Sayano et al. | |
| 2014/0030065 | A1 * | 1/2014 | Nakano | F01D 25/32 415/115 |
| 2017/0167301 | A1 * | 6/2017 | Fandrei, II | B23K 26/0624 |
| 2022/0154585 | A1 * | 5/2022 | Mizumi | F01D 25/32 |

FOREIGN PATENT DOCUMENTS

| | | | |
|---|---|---|---|
| JP | 3-131316 | | 6/1991 |
| JP | 2007-120478 | | 5/2007 |
| JP | 2007-309235 | | 11/2007 |
| JP | 2013-155725 | | 8/2013 |
| JP | 2017-20443 | | 1/2017 |
| JP | 2017-106451 | | 6/2017 |
| WO | 2009/157174 | | 12/2009 |
| WO | WO-2020175192 | A1 * | 9/2020 |
| WO | WO-2020175533 | A1 * | 9/2020 |
| WO | WO-2020250596 | A1 * | 12/2020 |
| WO | WO-2021117883 | A1 * | 6/2021 |

OTHER PUBLICATIONS

Written Opinion of the International Searching Authority dated Apr. 14, 2020 in corresponding International Application No. PCT/JP2020/005867, with English translation.

Reiner Furstner and Wilhelm Barthlott, "Wetting and Self-Cleaning Properties of Artificial Superhydrophobic Surfaces", Langmuir, 2005, vol. 21, pp. 956-961.

Solga, A. et al., "The dream of staying clean: Lotus and biomimetic surfaces", Bioinspiration and Biomimetics, 2007, vol. 2, No. 41, pp. S126-S134.

* cited by examiner

TURBINE STATOR BLADE AND STEAM TURBINE

TECHNICAL FIELD

The present invention relates to a turbine stator blade and a steam turbine.

Priority is claimed on Japanese Patent Application No. 2019-033564, filed Feb. 27, 2019, the content of which is incorporated herein by reference.

BACKGROUND ART

A steam turbine is equipped with a rotary shaft that is rotatable around an axis, a plurality of turbine rotor blade stages arranged at intervals in an axial direction on an outer peripheral surface of the rotary shaft, a casing that covers the rotary shaft and the turbine rotor blade stages from an outer peripheral side, and a plurality of turbine stator blade stages that are arranged alternately with the turbine rotor blade stages on an inner peripheral surface of the casing. A suction port that sucks steam from outside is formed on an upstream side of the casing, and an exhaust port is formed on a downstream side of the casing. The high-temperature and high-pressure steam sucked from the suction port is converted into a rotational force of the rotary shaft at the turbine rotor blade stage, after adjusting a flow direction and a velocity at the turbine stator blade stage.

As the steam passing through the turbine goes from upstream to downstream, the steam loses energy, and the temperature (and pressure) drops. Therefore, in the turbine stator blade stage on the most downstream side, part of steam is liquefied and exists in the air flow as fine water droplets, and some of the droplets attached to a surface of the turbine stator blade. The droplets quickly grow into a liquid film on the blade surface. The liquid film is constantly exposed to a high-speed steam flow around the liquid film. However, when the liquid film further grows and becomes thicker, part of the liquid film is torn by the steam flow and scattered in the form of huge droplets. The scattered droplets flow downstream, while gradually accelerating due to the steam flow. The larger the droplets are, the greater the inertial force is. Thus, the large droplets cannot pass between the turbine rotor blades on the mainstream steam, and therefore the large droplets collide with the turbine rotor blades. Since a peripheral speed of the turbine rotor blades may exceed the speed of sound, when the scattered droplets collide with the turbine rotor blades, the surfaces of the turbine rotor blades may be eroded and erosion may occur. In addition, the collision of droplets may hinder the rotation of the turbine rotor blades, and a braking loss may occur.

Various techniques have been proposed so far to prevent the adhesion and growth of such droplets. For example, in an apparatus described in Patent Literature 1 below, an extraction port for sucking a liquid film is formed on the surface of the turbine stator blade, and a hydrophilic removal surface that extends from a leading edge side of the turbine stator blade toward the extraction port is formed. After the liquid film moves along the removal surface, the liquid film can be sucked by the extraction port.

CITATION LIST

Patent Literature

[Patent Literature 1]
Japanese Unexamined Patent Application, First Publication No. 2017-106451

SUMMARY OF INVENTION

Technical Problem

Incidentally, droplets may be attached to the surface of the turbine stator blade to form a liquid film not only on an end edge on the upstream side (a leading edge) but also in the middle from the leading edge to a trailing edge. That is, a flow rate of the liquid film increases from upstream to downstream. However, because the hydrophilicity of the removal surface is uniform over the entire area in the apparatus described in Patent Literature 1, it is not possible to cope with an increase in flow rate of the liquid film. As a result, the liquid film may further grow on the upstream side than the extraction port and become the aforementioned huge droplets and scatter. That is, there is still room for improvement in the apparatus described in Patent Literature 1.

The present invention has been made to solve the aforementioned problems, and an object of the present invention is to provide a turbine stator blade and a steam turbine capable of further reducing the growth of a liquid film.

Solution to Problem

A turbine stator blade according to an aspect of the present invention includes a pressure side extending in a radial direction intersecting a flow direction of steam and facing upstream in the flow direction, in which a slit extending in the radial direction and capturing a liquefied component of the steam is formed on a downstream side of the pressure side, a hydrophilic uneven region having a liquid film capacity greater than that of the pressure side by being recessed in a depth direction intersecting the pressure side is formed in a further upstream position than the slit, and the hydrophilic uneven region has a depth in the depth direction increasing and a flow resistance decreasing toward downstream and toward the slit.

According to the aforementioned configuration, the depth of the hydrophilic uneven region increases toward downstream and toward the slit. Accordingly, in the hydrophilic uneven region, more droplets can be retained toward downstream. Here, on the surface of the turbine stator blade, the droplets may be attached not only to an end edge (a leading edge) on the upstream side but also in the middle from the leading edge to the trailing edge to form a liquid film. That is, the flow rate of the droplets increases from upstream to downstream. According to the aforementioned configuration, even if more droplets are attached to the middle from upstream to downstream, since the droplets can be retained by the hydrophilic uneven region, it is possible to reduce the possibility of scattering to downstream of the turbine stator blade.

In the turbine stator blade, the hydrophilic uneven region may include a plurality of protruding portions arranged at intervals in the flow direction and the radial direction, and a length between the protruding portions in the flow direction may be referred to as La and a length of the protruding portions in the flow direction may be referred to as Lb, a value of La/Lb may decrease toward downstream and toward the slit.

Flow resistance to the liquid film arises not only from an interaction between the liquid film and the wall surface, but also from an interaction between the liquid films. In particular, when the liquid film is water, the influence of the interaction is large. Here, since the droplets and the steam are attracted to each other between the droplets flowing between the protruding portions in the flow direction and the flow of the steam flowing between the protruding portions in the radial direction, a flow resistance to the flow of steam occurs. When the length between the protruding portions in the flow direction is referred to as La and the length of each of the protruding portions in the flow direction is referred to as Lb, the flow resistance decreases as the value of La/Lb becomes smaller. According to the aforementioned configuration, since the value of La/Lb becomes smaller toward downstream, the flow resistance with respect to the steam can be reduced toward the slit. As a result, it is possible to reduce the loss on the pressure side due to the formation of the hydrophilic uneven region.

In the turbine stator blade, the protruding portions may have rectangular shapes when viewed in a direction orthogonal to the pressure side and may have rectangular cross sections when viewed in the radial direction.

According to the aforementioned configuration, the protruding portion has a rectangular shape when viewed in the direction orthogonal to the pressure side, and has a rectangular cross section when viewed in the radial direction. Therefore, for example, the protruding portion can be formed more easily and inexpensively than in a case in which the protruding portion has a polygonal shape other than a rectangular shape or a columnar shape. As a result, it is possible to reduce the cost and time required for manufacturing the turbine stator blade.

In the turbine stator blade, the hydrophilic uneven region may have the depth in the depth direction increasing stepwise from upstream toward downstream in the flow direction.

According to the aforementioned configuration, the depth in the depth direction increases stepwise from upstream to downstream. Therefore, for example, the hydrophilic uneven region can be formed more easily and inexpensively as compared with a configuration in which the depth in the depth direction continuously increases. As a result, it is possible to reduce the cost and time required for manufacturing the turbine stator blade.

The turbine stator blade may further include a water-repellent region provided in a further upstream position than the hydrophilic uneven region in the flow direction and have higher water repellency than that of the pressure side.

According to the aforementioned configuration, since the water-repellent region has higher water repellency than the pressure side, before the droplets aggregate to form a larger liquid film, the droplets adhering to the water-repellent region flow away to downstream on the flow of steam. That is, the droplets can be made to flow to downstream in the state of fine droplets. As a result, it is possible to further suppress the formation of a liquid film due to the flow of droplets having a large particle size to downstream.

A steam turbine according to another aspect of the present invention includes a rotary shaft rotatable around an axis; a plurality of turbine rotor blades arranged in a circumferential direction with respect to an axis direction on an outer peripheral surface of the rotary shaft; a casing covering the rotary shaft and the turbine rotor blades from an outer peripheral side; and a plurality of the turbine stator blades according to any one of the above aspects arranged in the circumferential direction around the axis on an inner peripheral surface of the casing and provided adjacent to the turbine rotor blades in the axis direction.

According to the aforementioned configuration, it is possible to obtain a steam turbine in which growth of the liquid film is further reduced and a loss is reduced.

Advantageous Effects of Invention

According to the present invention, it is possible to provide a turbine stator blade and a steam turbine capable of further reducing the growth of a liquid film.

DESCRIPTION OF EMBODIMENTS

First Embodiment

Figure 1:
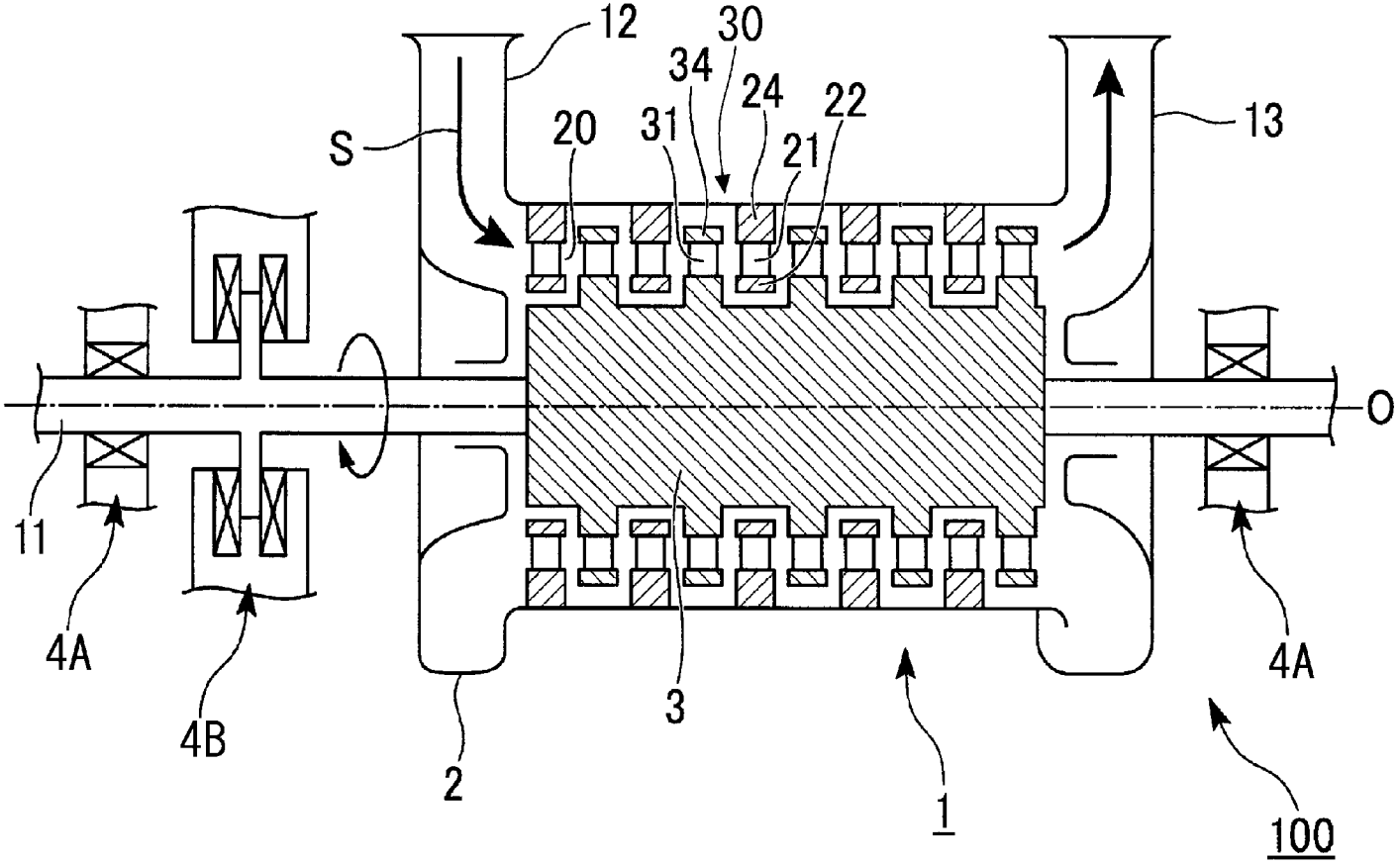
FIG. 1 is a schematic view showing a configuration of a steam turbine according to an embodiment of the present invention.

A first embodiment of the present invention will be described referring to FIGS. 1 to 6. A steam turbine 100 according to the present embodiment is equipped with a steam turbine rotor 3 extending in an axis O direction, a steam turbine casing 2 that covers the steam turbine rotor 3 from an outer peripheral side, and a journal bearing 4A and a thrust bearing 4B that support a shaft end 11 of the steam turbine rotor 3 to be rotatable around the axis O.

The steam turbine rotor 3 has a rotary shaft 1 extending along the axis O, and a plurality of rotor blades 30 provided on an outer peripheral surface of the rotary shaft 1. The plurality of rotor blades 30 are arranged at regular intervals in a circumferential direction of the rotary shaft 1. A plurality of rows of rotor blades 30 are also arranged at regular intervals in the direction of the axis O. Each of the rotor blades 30 has a rotor blade main body 31 (a turbine rotor blade) and a rotor blade shroud 34. The rotor blade main body 31 protrudes radially outward from the outer peripheral surface of the steam turbine rotor 3. The rotor blade main body 31 has an airfoil-shaped cross section when viewed in the radial direction. A rotor blade shroud 34 is provided at a tip end portion (an end portion on a radially outer side) of the rotor blade main body 31.

The steam turbine casing 2 has a substantially tubular shape that covers the steam turbine rotor 3 from the outer peripheral side. A steam supply pipe 12 which sucks steam S is provided on one side of the steam turbine casing 2 in the axis O direction. A steam exhaust duct 13 which discharges the steam S is provided on the other side of the steam turbine casing 2 in the axis O direction. The steam flows inside the steam turbine casing 2 from the one side toward the other side in the axis O direction. In the following description, a direction in which steam flows is simply referred to as a "flow direction". Further, a side on which the steam supply pipe 12 is located as viewed from the steam exhaust duct 13 is referred to as an upstream side in the flow direction, and a side on which the steam exhaust duct 13 is located as viewed from the steam supply pipe 12 is referred to as a downstream side in the flow direction.

A plurality of rows of stator blades 20 are provided on the inner peripheral surface of the steam turbine casing 2. Each of the stator blades 20 has a stator blade main body 21 (a turbine stator blade), a stator blade shroud 22, and a stator blade pedestal 24. The stator blade main body 21 is an airfoil-shaped member connected to the inner peripheral surface of the steam turbine casing 2 via the stator blade pedestal 24. Further, a stator blade shroud 22 is provided at the tip end portion (an end portion in a radially inner side) of the stator blade main body 21. Similarly to the rotor blades 30, the plurality of stator blades 20 are arranged on the inner peripheral surface in the circumferential direction and the direction of the axis O. The rotor blades 30 are disposed to enter a region between the plurality of adjacent stator blades 20. That is, the stator blades 20 and the rotor blades 30 extend in a direction (a radial direction with respect to the axis O) intersecting the flow direction of steam.

The steam S is supplied to the inside of the steam turbine casing 2 configured as described above via the steam supply pipe 12 on the upstream side. On the way through the inside of the steam turbine casing 2, the steam S alternately passes through the stator blades 20 and the rotor blades 30. The stator blade 20 rectifies the flow of the steam S, and the rectified mass of the steam S pushes the rotor blade 30 to give a rotational force to the steam turbine rotor 3. The rotational force of the steam turbine rotor 3 is extracted from the shaft end 11 and used to drive an external device (a generator or the like). As the steam turbine rotor 3 rotates, the steam S is discharged toward a subsequent device (a condenser or the like) through the steam exhaust duct 13 on the downstream side.

Journal bearings 4A support a radial load with respect to the axis O. One journal bearing 4A is provided at each end of the steam turbine rotor 3. The thrust bearing 4B supports a load in the direction of the axis O. The thrust bearing 4B is provided only at the end portion on the upstream side of the steam turbine rotor 3.

Figure 2:
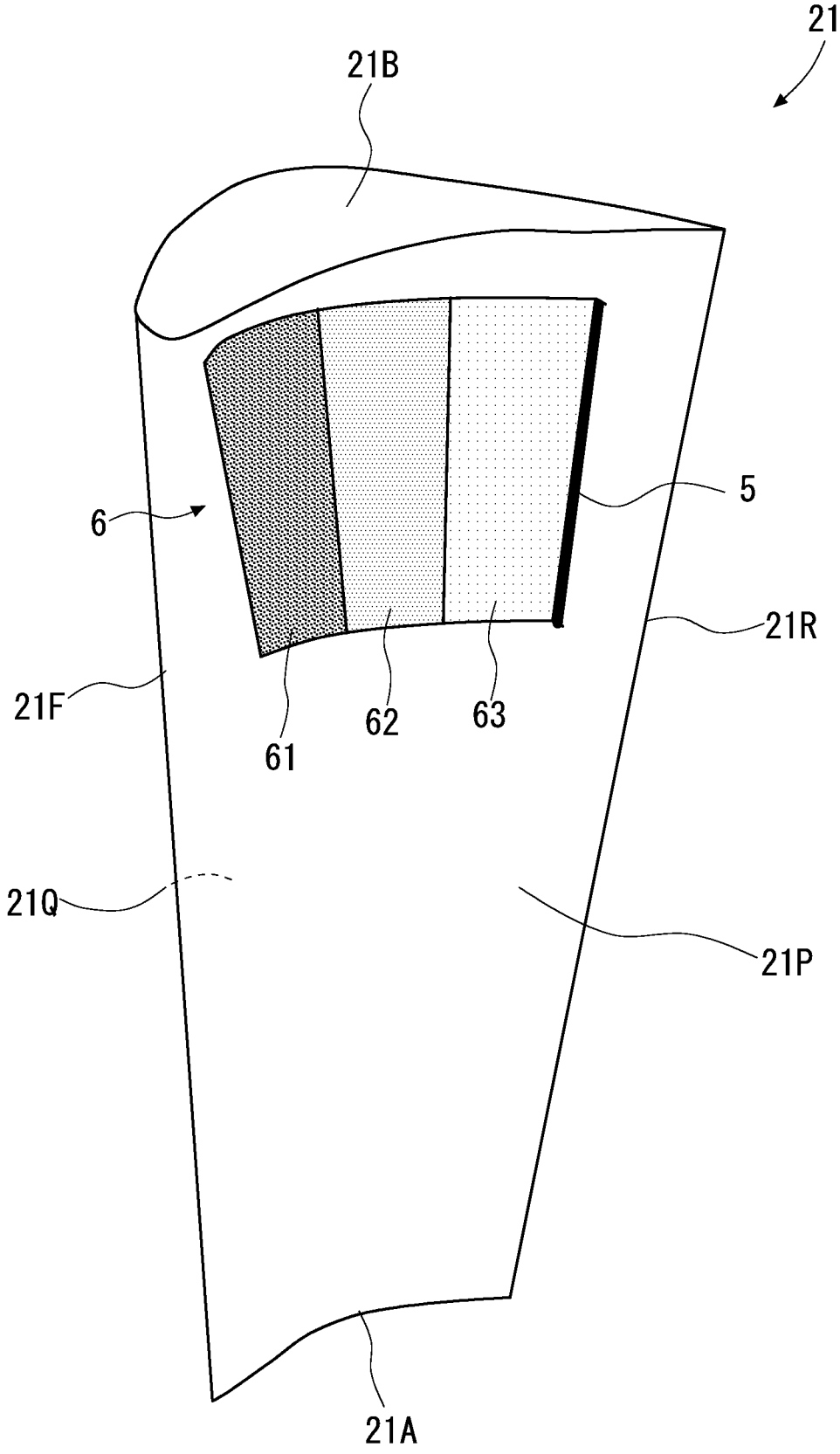
FIG. 2 is a perspective view showing a configuration of a turbine stator blade according to a first embodiment of the present invention.

Next, the configuration of the stator blade main body 21 will be described referring to FIG. 2. The stator blade main body 21 extends in the radial direction (radial direction with respect to the axis O), which is a direction intersecting the flow direction. The cross section of the stator blade main body 21 viewed in the radial direction has an airfoil shape. More specifically, the leading edge 21F, which is an end edge on the upstream side in the flow direction, has a curved surface shape. A trailing edge 21R, which is an end edge on the downstream side, has a tapered shape in which a length in the circumferential direction gradually decreases when viewed in the radial direction. From the leading edge 21F to the trailing edge 21R, the stator blade main body 21 is gently curved from one side toward the other side in the circumferential direction with respect to the axis O.

A surface of the stator blade main body 21 on one side in the circumferential direction is a suction side 21Q facing downstream in the flow direction. The suction side 21Q has a curved surface shape that is convex toward the one side in the circumferential direction. On the other hand, a surface of the stator blade main body 21 on the other side in the circumferential direction is a pressure side 21P facing upstream in the flow direction. The pressure side 21P has a curved surface shape that is concave toward the one side in the circumferential direction. In a state in which the steam is flowing, the pressure on the pressure side 21P becomes higher than the pressure on the suction side 21Q.

An end surface facing radially inward of the stator blade main body 21 is the inner peripheral side end surface 21A, and an end surface facing radially outward is the outer peripheral side end surface 21B. The stator blade shroud 22 and the stator blade pedestal 24 shown in FIG. 1 are omitted in FIG. 2.

A slit 5 and a hydrophilic uneven region 6 are formed at a portion on the pressure side 21P biased toward the outer peripheral side end surface 21B (that is, a portion closer to the outer peripheral side end surface 21B than to the inner peripheral side end surface 21A). The slit 5 is a rectangular hole extending in the radial direction on the pressure side 21P. A long side of the slit 5 extends in the radial direction, and a short side thereof extends in the above-mentioned flow direction. As will be described in detail later, the slit 5 is formed to capture the liquefied components (droplets) of the steam flowing from the leading edge 21F toward the trailing edge 21R along the pressure side 21P. The slit 5 is connected to a flow path (not shown) formed inside the stator blade main body 21, and the captured droplets are sent to outside of the stator blade main body 21 through this flow path.

The hydrophilic uneven region 6 is adjacent to the slit 5 and extends in a further upstream position (the leading edge 21F side) than the slit 5 in the flow direction. The hydrophilic uneven region 6 has higher hydrophilicity than the pressure side 21P and is provided to cause the droplets flowing from the leading edge 21F side along the pressure side 21P to flow into the slit 5 on the trailing edge 21R side, without repelling the droplets. The hydrophilic uneven region 6 is divided into three regions in the flow direction from the leading edge 21F to the trailing edge 21R. A region closest to the leading edge 21F is a first region 61, and a region closest to the trailing edge 21R is a third region 63. A region between the first region 61 and the third region 63 is a second region 62.

The liquid film capacity is higher in the second region 62 than in the first region 61. The liquid film capacity is higher in the third region 63 than in the second region 62. The term "liquid film capacity" used here indicates the amount of permeation and the amount of retention of the liquid film in that region. Further, the amount of permeation and the amount of retention are determined by the porosity in that region. Further, the flow resistance to the droplets is smaller in the second region 62 than in the first region 61. The flow resistance to the droplets is smaller in the third region 63 than in the second region 62.

Figure 3:
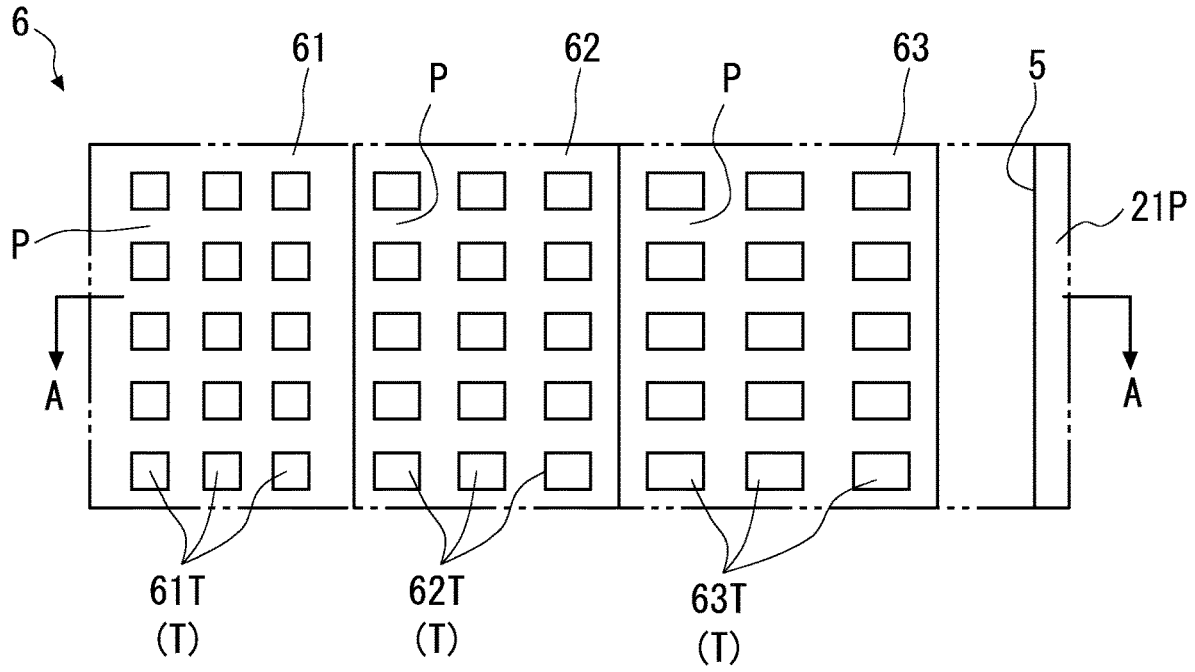
FIG. 3 is an enlarged view showing a configuration of a pressure side of a turbine stator blade according to the first embodiment of the present invention.

More specifically, as shown in FIG. 3, when the hydrophilic uneven region 6 is viewed microscopically, a plurality of protruding portions T are provided in each of the first region 61, the second region 62, and the third region 63. The protruding portions T have rectangular shape when viewed in a direction orthogonal to the pressure side 21P and have substantially rectangular cross sections when viewed in the radial direction. In the present embodiment, the protruding portions T of the first region 61 (first protruding portions 61T) form, for example, squares when viewed from the direction orthogonal to the pressure side 21P. The first protruding portions 61T are arranged in a grid pattern at intervals in the flow direction and the radial direction. Further, the shapes of the cross sections of the protruding portions T also allow a machining error as long as the shapes of the cross sections of the protruding portions T are substantially rectangular shapes.

A protruding portion T (a second protruding portion 62T) of the second region 62 has a rectangular shape when viewed in the direction orthogonal to the pressure side 21P. Specifically, a length in the flow direction of the second protruding portion 62T is slightly longer than that of the first protruding portion 61T. Like the first protruding portion 61T, the second protruding portion 62T is also arranged in a grid pattern at intervals in the flow direction and the radial direction. A protruding portion T (a third protruding portion 63T) of the third region 63 has a rectangular shape in which a length in the flow direction of the third protruding portion 63T is longer than that of the second protruding portion 62T. Like the second protruding portion 62T, the third protruding portion 63T is also arranged in a grid pattern at intervals in the flow direction and the radial direction.

Among spaces formed between the protruding portions T, a space formed in the radial direction (that is, the direction orthogonal to the flow direction of steam) is referred to as a flow path P. The flow path P is formed by making a space formed between a pair of protruding portions T adjacent to each other in the radial direction continuous in the flow direction. As will be described in detail below, part of the droplets and the steam can flow in the flow direction through the flow path P.

Figure 4:
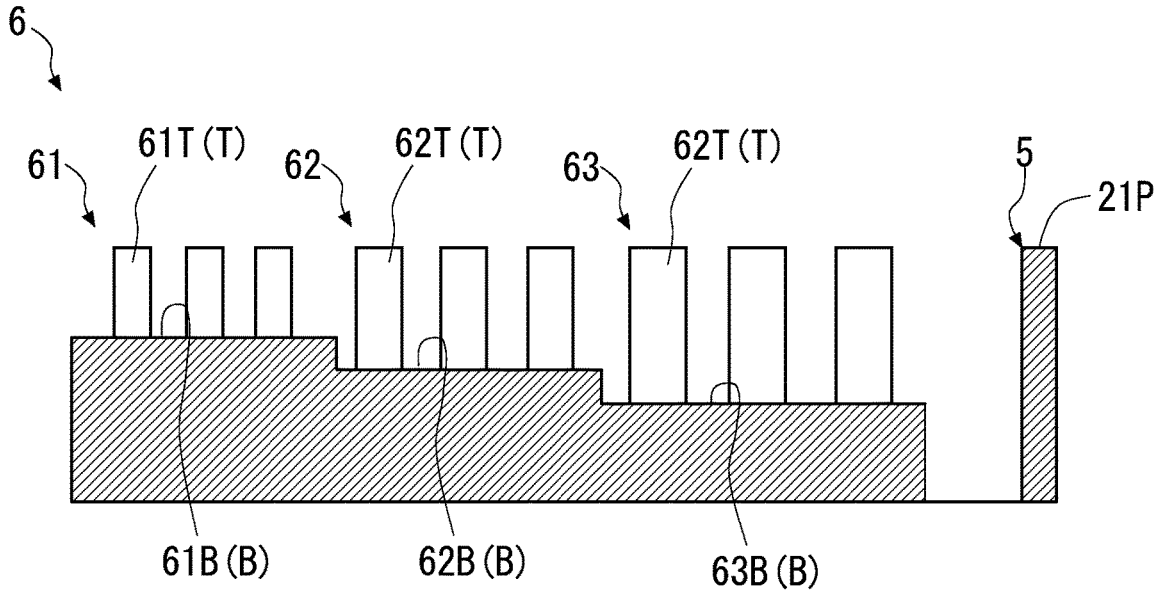
FIG. 4 is a view of a cross section along a line A-A of FIG. 3.

Further, as shown in FIG. 4, in the hydrophilic uneven region 6, a height of a bottom surface B in the direction orthogonal to the pressure side 21P changes stepwise from the first region 61 toward the third region 63. More specifically, the distance (a depth in a depth direction) from the pressure side 21P to the bottom surface B increases stepwise toward the slit 5. The bottom surface B (a second bottom surface 62B) of the second region 62 is formed at a deeper position than the bottom surface B (a first bottom surface 61B) of the first region 61. The bottom surface B (a third bottom surface 63B) of the third region 63 is formed at a deeper position than the second bottom surface 62B. The first bottom surface 61B, the second bottom surface 62B, and the third bottom surface 63B each have a shape along the pressure side 21P. In addition, although FIG. 4 describes the first bottom surface 61B, the second bottom surface 62B, and the third bottom surface 63B each having a planar shape to simplify the illustration, actually, the first bottom surface 61B, the second bottom surface 62B, and the third bottom surface 63B are also curved in a curved surface shape in accordance with the curved surface shape of the pressure side 21P. The third bottom surface 63B is connected to the end edge of the slit 5 on the upstream side.

Figure 5:
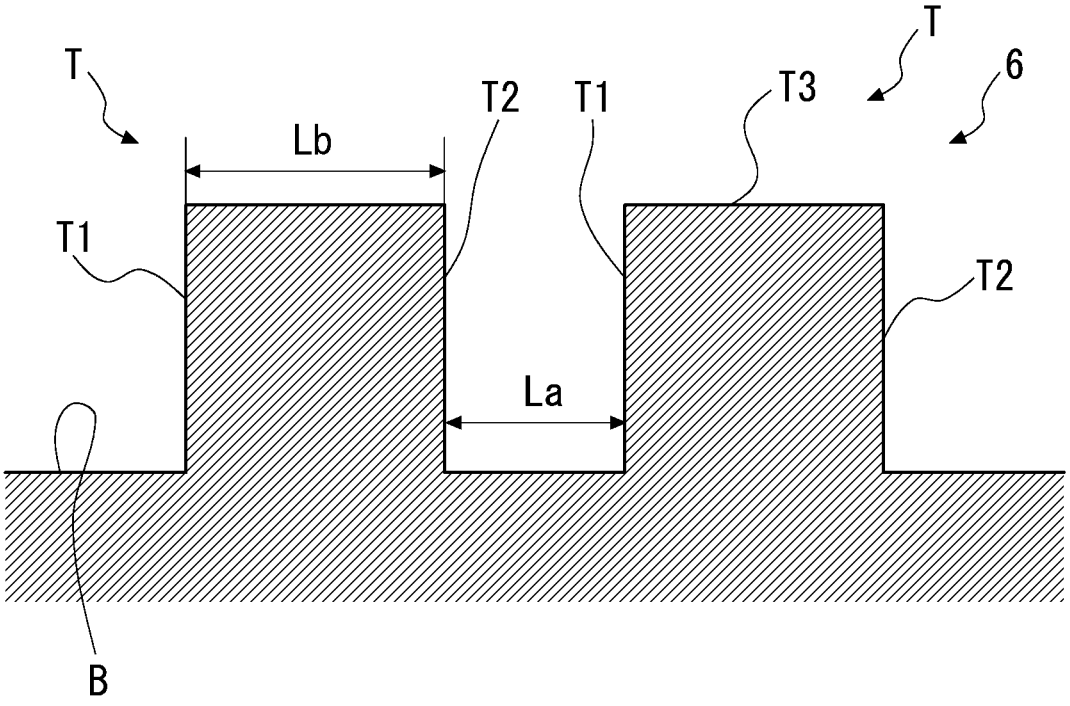
FIG. 5 is an enlarged view of a cross section of a hydrophilic uneven region according to the first embodiment of the present invention.

As shown in FIG. 5, when a length between the protruding portions in the flow direction is referred to as La and a length of the protruding portion T in the flow direction is referred to as Lb, the value of the length ratio La/Lb of the protruding portion T decreases stepwise from the first region 61 toward the third region 63. More specifically, the distance between the first end surface T1 of one protruding portion T facing upstream in the flow direction and the second end surface T2 of another protruding portion T adjacent to the protruding portion T facing downstream in the flow direction is referred to as La. Further, a length from the first end surface T1 to the second end surface T2 of one protruding portion T (that is, a length of a top surface T3 of the protruding portion T in the flow direction) is referred to as Lb. Desirably, in the first region 61, the value of the length ratio La/Lb is set to a value smaller than 1. More preferably, La/Lb<0.8. Most preferably, La/Lb<0.5.

As described above, since a length of the long side of the rectangle formed by the protruding portion T increases stepwise from the first region 61 to the third region 63, the value of the length ratio La/Lb decreases stepwise from the first region 61 toward the third region 63. The value of La (that is, a pitch of the protruding portion T) is less than 1 μm or 100 μm or more. In forming the protruding portion T as described above, short pulse machining and laser machining including surface interference wave processing are preferably used.

It is known that when the protruding portion T is configured as described above, the hydrophilic uneven region 6 exhibits high hydrophilicity. A state of "high hydrophilicity" as used herein refers to the state in which a contact angle formed by the droplets adhering to the hydrophilic uneven region with respect to the surface of the hydrophilic uneven region is smaller than 90°. In particular, the state in which the contact angle is less than 5° is called super-hydrophilicity.

Figure 6:
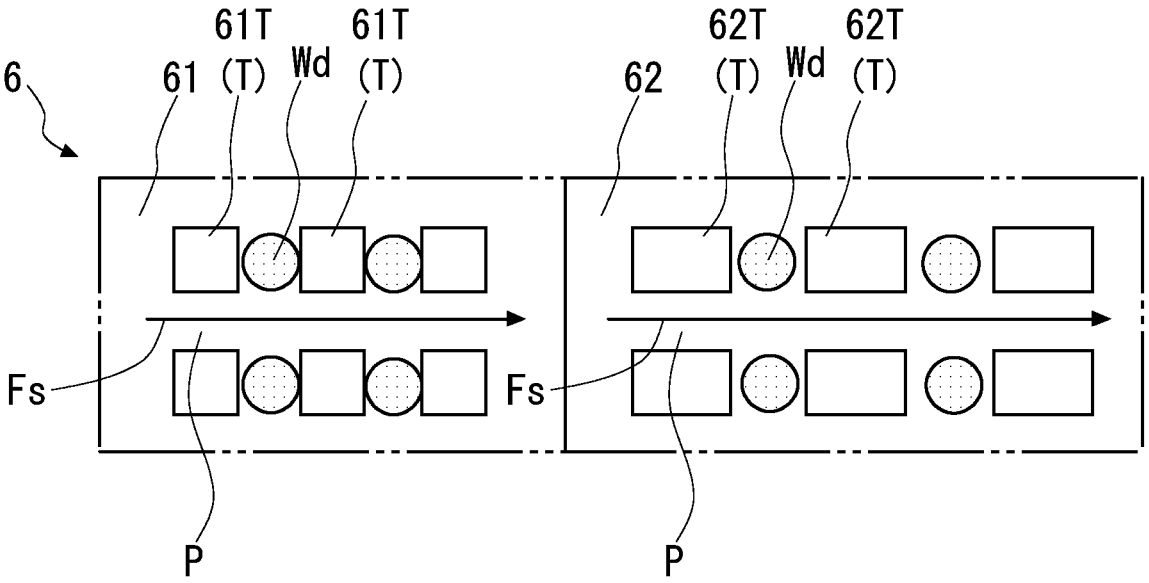
FIG. 6 is an explanatory diagram showing the behavior of droplets in the hydrophilic uneven region according to the first embodiment of the present invention.

Further, since the value of La/Lb decreases stepwise from the first region 61 to the third region 63, the flow resistance to the steam flowing through the flow path P can be reduced stepwise. Specifically, as shown in FIG. 6, when the droplets Wd stay in the space between the first protruding portions 61T adjacent to each other in the flow direction, a pulling force by the droplets Wd with respect to the steam flow Fs flowing through the flow path P is generated. The force becomes a flow resistance with respect to the steam flow Fs. That is, by reducing the value of the above-mentioned length ratio La/Lb, the pulling force by the droplets Wd per unit length of the flow path P decreases. Therefore, as shown in FIG. 6, in the second region 62, the pulling force by the droplets Wd captured between the second protruding portions 62T becomes smaller than the pulling force in the first region 61. Similarly, in the third region 63, the pulling force by the droplets captured between the third protruding portions 63T becomes smaller than the pulling force in the second region 62. That is, in the hydrophilic uneven region 6, the flow resistance with respect to the steam flow Fs becomes smaller toward downstream and toward the slit 5.

Subsequently, the behavior of steam in the stator blade main body 21 according to the present embodiment will be described. The temperature of the steam passing through the steam turbine casing 2 decreases, as the steam works from upstream to downstream. Therefore, in the turbine stator blade stage on the most downstream side, part of the steam is liquefied and attached to the surface of the stator blade main body 21 as droplets (water droplets). The droplets gradually grow into a liquid film. When the liquid film grows further, part of the liquid film is torn off and scattered as huge droplets. The scattered droplets try to enter the mainstream of steam and flow to downstream, but the huge droplets cannot enter the mainstream sufficiently due to the large inertial force acting on the huge droplets, and collides with the turbine rotor blade (the rotor blade main body 31). Since the peripheral speed of the turbine rotor blade may exceed the speed of sound, when the scattered droplets collide with the turbine rotor blade, the surface of the turbine rotor blade may be eroded and erosion may occur. In addition, the rotation of the turbine rotor blades may be hindered by the collision of droplets, and a braking loss may occur.

However, in the stator blade main body 21 according to the present embodiment, the slit 5 and the hydrophilic uneven region 6 are formed on the pressure side 21P. Therefore, most of the droplets can be captured by the slit 5, and the possibility of scattering toward downstream can be reduced. Further, since the hydrophilic uneven region 6 having a larger liquid film capacity than that of the pressure side 21P is formed in a further upstream position than the slit 5, the droplets adhering to the hydrophilic uneven region 6 diffuses and familiar to the hydrophilic uneven region 6 immediately after adhering. As a result, it is possible to reduce the possibility that the droplets aggregate and grow.

Here, on the surface of the stator blade main body 21, the droplets may be attached not only to the end edge (the leading edge 21F) on the upstream side but also in the middle from the leading edge 21F to the trailing edge 21R to form a liquid film. That is, the flow rate of the liquid film increases from upstream to downstream on the pressure side 21P. Therefore, if the hydrophilicity is uniform over the entire region in the flow direction, it is not possible to cope with the increase in the flow rate of the liquid film. As a result, there is a likelihood that the liquid film may further grow on upstream of the slit 5 and become huge droplets and scatter.

However, in the aforementioned configuration, the depth of the hydrophilic uneven region 6 increases toward downstream and toward the slit 5. As a result, in the hydrophilic uneven region 6, more droplets can be retained toward downstream. That is, the apparent liquid film capacity increases toward downstream. Therefore, even if more droplets are attached to the middle from upstream to downstream, since the droplets can be retained by the second region 62 or the third region 63 of the hydrophilic uneven region 6, it is possible to reduce the possibility of scattering to downstream side of the stator blade main body 21.

Incidentally, between the droplets Wd flowing between the protruding portions T in the flow direction and the flow Fs of the steam flowing between the protruding portions T in the radial direction, the droplets Wd and the steam are attracted to each other and a flow resistance to the steam flow Fs occurs. When the length between the protruding portions T in the flow direction is referred to as La, and the length of each of the protruding portions in the flow direction is referred to as Lb, the flow resistance decreases as the value of La/Lb becomes smaller. According to the aforementioned configuration, since the value of the length ratio La/Lb becomes smaller toward downstream, the flow resistance with respect to the steam flow Fs can be reduced toward the slit 5. As a result, it is possible to reduce the loss on the pressure side 21P due to the formation of the hydrophilic uneven region 6.

Further, according to the aforementioned configuration, the protruding portion T has a rectangular shape when viewed from the direction orthogonal to the pressure side 21P and has a rectangular cross section when viewed in the radial direction. Therefore, for example, the protruding portion T can be formed more easily and inexpensively than in a case in which the protruding portion T has a polygonal shape other than a rectangular shape or a columnar shape. As a result, it is possible to reduce the cost and time required for manufacturing the stator blade main body 21.

In addition, according to the aforementioned configuration, the length of the hydrophilic uneven region 6 in the depth direction increases stepwise from upstream to downstream. Therefore, for example, the hydrophilic uneven region 6 can be formed more easily and inexpensively as compared with a configuration in which the depth in the depth direction continuously increases. As a result, it is possible to reduce the cost and time required for manufacturing the stator blade main body 21.

The first embodiment of the present invention has been described above. Various changes and modifications can be made to the aforementioned configuration within the scope of the present invention. For example, in the first embodiment, an example in which the hydrophilic uneven region 6 is divided into three regions of the first region 61, the second region 62, and the third region 63 has been described. However, the aspect of the hydrophilic uneven region 6 is not limited to the aforementioned example, and it is also possible to adopt a configuration in which the hydrophilic uneven region 6 is divided into four or more regions having different hydrophilicity.

Second Embodiment

Figure 7:
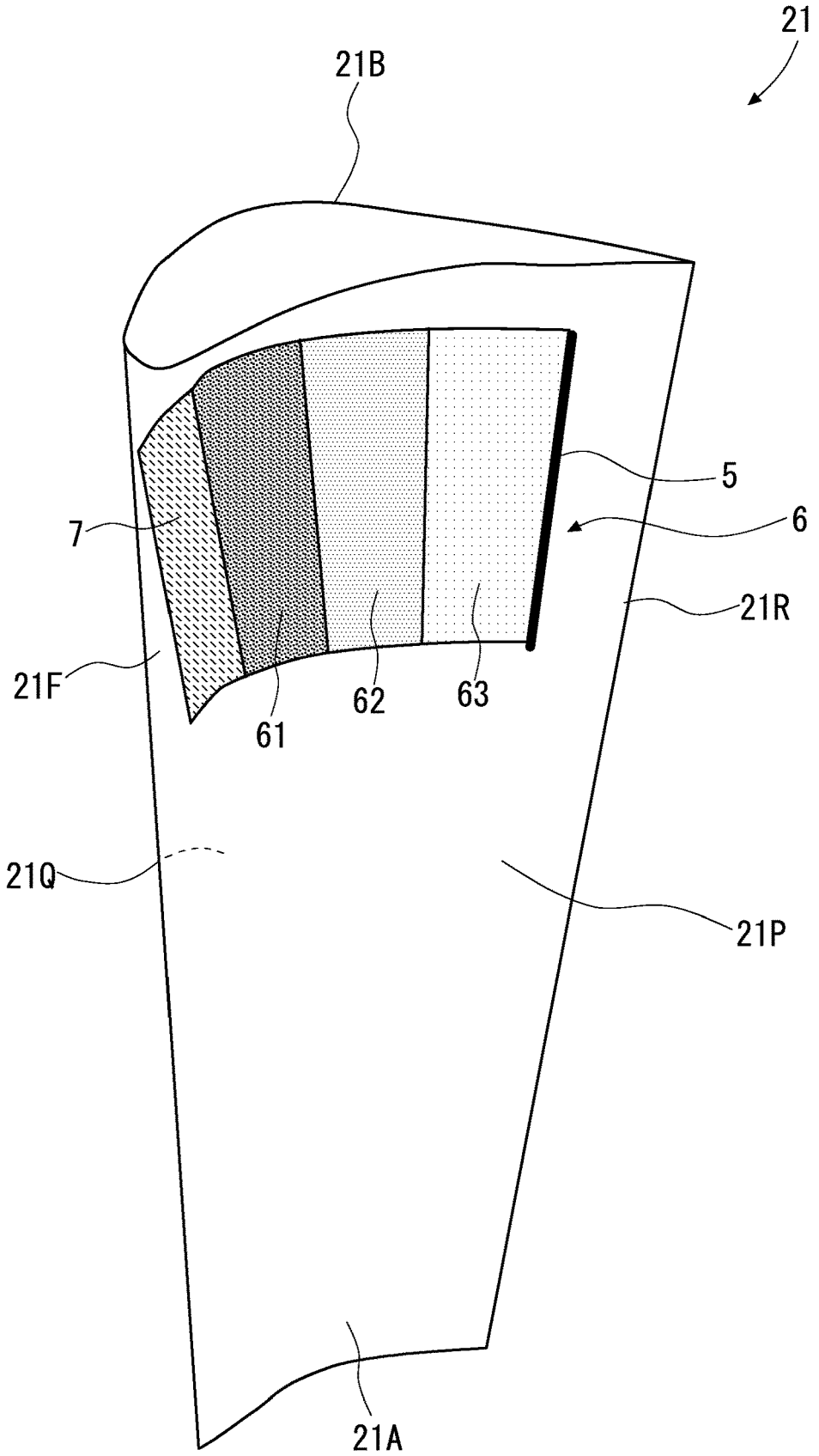
FIG. 7 is a perspective view showing a configuration of a turbine stator blade according to a second embodiment of the present invention.

Next, a second embodiment of the present invention will be described referring to FIG. 7. The same components as those in the first embodiment are denoted by the same reference numerals, and a detailed description thereof will not be provided. As shown in FIG. 7, in the present embodiment, a water-repellent region 7 exhibiting water repellency is provided in the further upstream position than the hydrophilic uneven region 6. The expression "exhibiting water repellency" as used herein indicates the state in which a contact angle formed by the droplets adhering to the water-repellent region 7 is 90° or more. That is, the droplets that have reached the water-repellent region 7 are repelled without adhering to the water-repellent region 7 for a long time and reaches the hydrophilic uneven region 6 on the downstream side. That is, in the water-repellent region 7, before the droplets aggregate to form a larger liquid film, the droplets enter the flow of steam and flow away to downstream. That is, the droplets can be made to flow to downstream in the state of the fine droplets. As a result, it is possible to further suppress the formation of a liquid film due to the flow of droplets having a large particle size to downstream.

Here, the above-mentioned state in which the contact angle is 150° or more is called a super-water-repellent state, and since it is possible to exert a more water-repellent function, it is possible to more effectively suppress the formation of a liquid film.

The second embodiment of the present invention has been described above. Various changes and modifications can be made to the aforementioned configuration within the scope of the present invention.

INDUSTRIAL APPLICABILITY

According to the present invention, it is possible to provide a turbine stator blade and a steam turbine capable of further reducing the growth of a liquid film.

REFERENCE SIGNS LIST

100 Steam turbine
1 Rotary shaft
2 Steam turbine casing
3 Steam turbine rotor
4A Journal bearing
4B Thrust bearing
5 Slit
6 Hydrophilic uneven region
7 Water-repellent region
11 Shaft end
12 Steam supply pipe
13 Steam exhaust duct
20 Stator blade
21 Stator blade main body
21A Inner peripheral side end surface
21B Outer peripheral side end surface
21F Leading edge

21P Pressure side
21Q Suction side
21R Trailing edge
22 Stator blade shroud
30 Rotor blade
31 Rotor blade main body
34 Rotor blade shroud
51 Slit main body
52 Enlarged portion
61 First region
61B First bottom surface
61T First protruding portion
62 Second region
62B Second bottom surface
62T Second protruding portion
63 Third region
63B Third bottom surface
63T Third protruding portion
B Bottom surface
Fs Steam flow
O Axis
P Flow path
S Steam
T Protruding portion
T1 First end surface
T2 Second end surface
T3 Top surface
Wd Droplet

The invention claimed is:

1. A turbine stator blade comprising:

a pressure side extending in a radial direction intersecting a flow direction of steam and facing upstream in the flow direction, wherein a slit extending in the radial direction and capturing a liquefied component of the steam is formed on a downstream side of the pressure side, a hydrophilic uneven region having a liquid film capacity greater than that of the pressure side by being recessed in a depth direction intersecting the pressure side is formed in a further upstream position than the slit, and the hydrophilic uneven region has a depth in the depth direction increasing and a flow resistance decreasing toward downstream and toward the slit.

2. The turbine stator blade according to claim 1, wherein the hydrophilic uneven region includes a plurality of protruding portions arranged at intervals in the flow direction and the radial direction, and a length between the protruding portions in the flow direction is referred to as La, a length of each of the protruding portions in the flow direction is referred to as Lb, and a value of La/Lb decreases toward downstream and toward the slit.

3. The turbine stator blade according to claim 2, wherein the protruding portions have rectangular shapes when viewed in a direction orthogonal to the pressure side and have rectangular cross sections when viewed in the radial direction.

4. The turbine stator blade according to claim 1, wherein the hydrophilic uneven region has the depth in the depth direction increasing stepwise from upstream toward downstream in the flow direction.

5. The turbine stator blade according to claim 1, further comprising a water-repellent region provided in a further upstream position than the hydrophilic uneven region in the flow direction and has higher water repellency than that of the pressure side.

6. A steam turbine comprising:

a rotary shaft rotatable around an axis;

a plurality of turbine rotor blades arranged in a circumferential direction with respect to an axis direction on an outer peripheral surface of the rotary shaft;

a casing covering the rotary shaft and the turbine rotor blades from an outer peripheral side; and a plurality of the turbine stator blades according to claim 1 arranged in the circumferential direction around the axis on an inner peripheral surface of the casing and provided adjacent to the turbine rotor blades in the axis direction.

* * * * *